United States Patent [19]

Hollier, Jr.

[11] 4,391,415

[45] Jul. 5, 1983

[54] FACILITATING THE EXCHANGE OF A FINISHED PACKAGE WITH A NEW CORE

[75] Inventor: Joseph H. Hollier, Jr., Pearcy, Ark.

[73] Assignee: Sutco, Inc., Hot Springs, Ark.

[21] Appl. No.: 256,847

[22] Filed: Apr. 23, 1981

[51] Int. Cl.[3] ..... B65H 19/04

[52] U.S. Cl. ..... 242/56.9; 242/81

[58] Field of Search ..... 242/56.9, 35.5 A, 79, 242/80, 81, 56 R, 56 A, 56.2, 64, 68.5, 68.3

[56] References Cited

U.S. PATENT DOCUMENTS 3,424,398 1/1969 Garnier ..... 242/81

4,208,019 6/1980 Dusenbery ..... 242/56.9

*Primary Examiner*—Edward J. McCarthy

*Attorney, Agent, or Firm*—George F. Helfrich

[57] ABSTRACT

A device for winding a plurality of endless webs of stock material on individual cores on a driven cantilevered support shaft to prepare finished packages of the stock material is provided with a secondary, non-driven cantilevered support shaft located in a first position in proximity to, but spaced from the driven support shaft. The secondary support shaft has a diameter which is substantially equal to the diameter of the driven support shaft, and the secondary support shaft is mounted for movement from its first position to a second position wherein the secondary support shaft and the driven support shaft are in a longitudinal, end-to-end alignment, and are contiguous. While located in its first position, the secondary support shaft is loaded with a plurality of unused cores. Upon conclusion of a winding operation, finished packages are removed from the driven support shaft, while the secondary support shaft is located in its first position. The secondary support shaft is then moved to its second position, and the unused cores are speedily conveyed from the secondary support shaft onto the driven support shaft and secured in position thereon. The secondary support shaft is then returned to its first position, and another winding operation is allowed to commence.

1 Claim, 5 Drawing Figures

FACILITATING THE EXCHANGE OF A FINISHED PACKAGE WITH A NEW CORE

BACKGROUND OF THE INVENTION

1. Field of the Invention

The present invention relates generally to a device for handling stock material. In particular, it relates to an improvement for facilitating the exchange of finished packages on a driven cantilevered support shaft with new cores upon completion of a winding operation.

2. Prior Art

In the handling of stock material by winding a plurality of endless webs thereof on individual cores on a driven cantilevered support shaft to prepare finished packages of the stock material, there has been a need for facilitating the exchange of finished packages on the driven support shaft with new cores upon completion of a winding operation. Fitting a plurality of new cores individually upon the driven support shaft, after finished packages have been removed therefrom at the conclusion of a winding operation, has resulted in excessive down time, because of the inherent slowness of such an operation. In an operation such as winding, excessive down time cannot be tolerated. Indeed, many of today's manufacturing operations must be made even more efficient, if they are to remain competitive.

SUMMARY OF THE INVENTION

It is accordingly the primary object of the present invention to provide a simple and efficient, time-saving improvement for overcoming the disadvantages of the prior art by facilitating the exchange of finished packages on a driven cantilevered support shaft with new cores upon completion of a winding operation. The improvement of the present invention comprises (a) A secondary, non-driven cantilevered support shaft located in a first position in proximity to, but spaced from the driven support shaft. The secondary support shaft has a diameter which is substantially equal to the diameter of the driven support shaft and is mounted for movement from the first position thereof to a second position thereof wherein the secondary support shaft and the driven support shaft are in a longitudinal, end-to-end alignment, and are contiguous;

(b) Means (e.g., hand charging) for loading a plurality of unused cores onto the secondary support shaft during the winding operation, while the secondary support shaft is located in the first position thereof;

(c) Means (e.g., hand discharging) for removing the finished packages from the driven support shaft upon conclusion of the winding operation, while the secondary support shaft is located in the first position thereof;

(d) Means (either standard translated or rotational) for moving the secondary support shaft from the first position thereof to the second position thereof;

(e) Means (e.g., hand traversing) for conveying the unused cores from the secondary support shaft onto the driven support shaft, and means for securing the cores in position thereon; and (f) Means (either standard translational or rotational) for moving the secondary support shaft from the second position thereof to the first position thereof.

Especially beneficial results are obtained when the plurality of endless webs of stock material being wound are a plurality of cellulosic fiber strips, such as those which are widely utilized as "wallboard tape".

BRIEF DESCRIPTION OF THE DRAWING

For a more complete understanding of the present invention, including its primary object and benefits, reference should be made to the detailed description of the preferred embodiments thereof, which is set forth below. This description should be read together with the accompanying drawings, wherein.

DETAILED DESCRIPTION OF THE PREFERRED EMBODIMENTS

Figure 1:
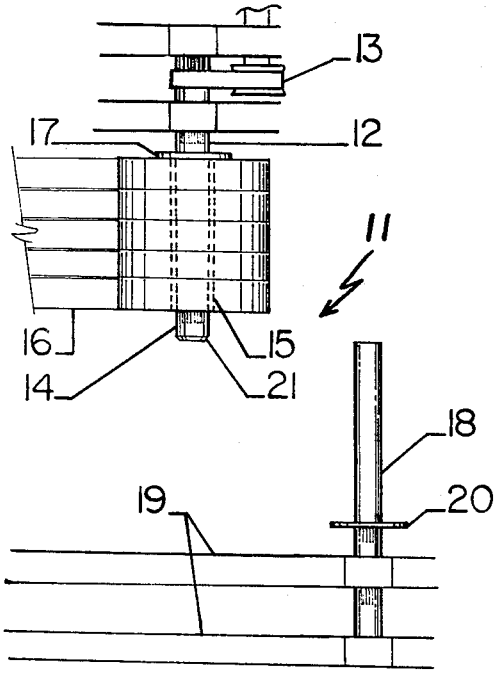
FIG. 1 is a schematic top view illustrating a device for winding a plurality of endless webs of stock material on individual cores on a driven cantilevered support shaft to prepare finished packages of the stock material, the device including a secondary, non-driven cantilevered support shaft located in a first position in proximity to, but spaced from the driven support shaft.
Figure 4:
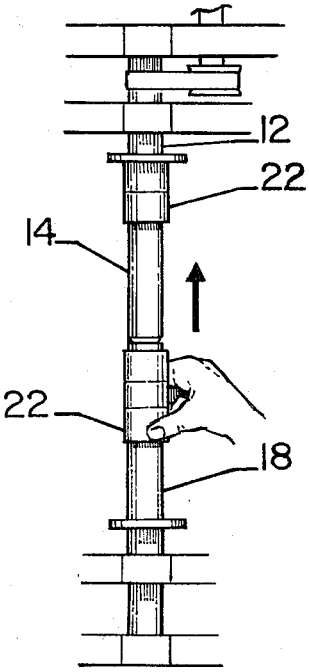
FIG. 4 is a schematic top view showing the secondary support shaft of FIG. 3 having been moved to its second position, and the unused cores being conveyed from the secondary support shaft onto the driven support shaft.
Figure 5:
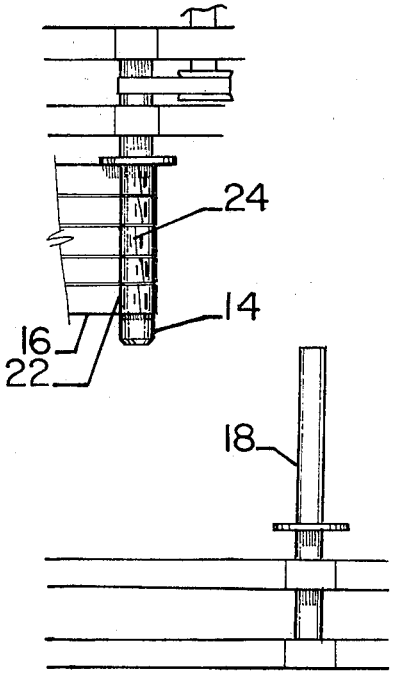
FIG. 5 is a schematic top view showing the secondary support shaft of FIG. 4 having been returned to its first position and another winding operation having been allowed to commence.

Referring now to the drawings, there is shown in FIG. 1 a device (11) according to the present invention. Provided is support shaft (12), which is supported at one end (cantilevered) and driven at the same end by standard drive means such as the standard belt means (13) shown. The free end section (14) of the driven cantilevered support shaft (12) is adapted to securely hold a plurality of individual cores (15) upon which endless webs of stock material (16) from a source not shown are wound to prepare finished packages thereof. The cores (15) are held in place on the free end section (14) as by radially expanding the free end section (14) after the cores (15) are in place thereon, or by like means. Free end section (14) is also provided with a stop (17) to prevent cores from sliding off the free end section (14) before being locked in place thereon. Located in a first position in proximity to the free end section (14) of driven cantilevered support shaft (12) but spaced therefrom is a secondary, non-driven shaft (18), which is supported at one end (cantilevered), and mounted at this same end by standard mounting means (19) for translational or rotational movement to a second position as shown in FIG. 4, and described below. Secondary shaft (18) has a stop (20) to prevent cores from sliding off the secondary support shaft (18) when being loaded thereon. The free end of secondary support shaft (18) has a diameter which is substantially equal to the normal, unexpanded diameter of the free end section (14) of driven cantilevered support shaft (12). It is especially advantageous if free end section (14) is chamfered or beveled as at (21) for facilitating the transfer of cores, which is shown in FIG. 4 and described below. The second position of secondary, non-driven support shaft (18), which is shown in FIG. 4, is characterized by the secondary support shaft (18) and the driven support shaft (12), especially the free end section (14) thereof, being in a longitudinal, end-to-end alignment, and contiguous.

Figure 2:
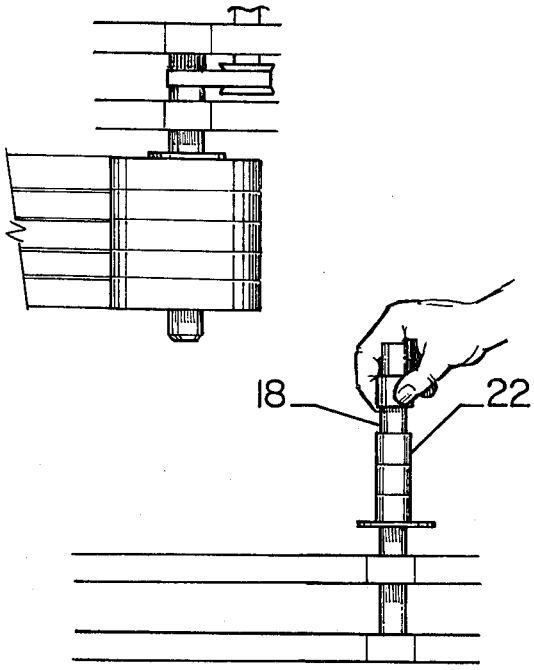
FIG. 2 is a schematic top view showing the secondary support shaft of FIG. 1 being loaded with a plurality of unused cores.

During the winding operation, the secondary, non-driven support shaft (18) is loaded with a plurality of unused cores (22) while the non-driven shaft (18) is located in its first position. Such loading is conveniently accomplished by hand, or by other means, such as automatic loading means, if desired. FIG. 2 is illustrative of such an operation.

Figure 3:
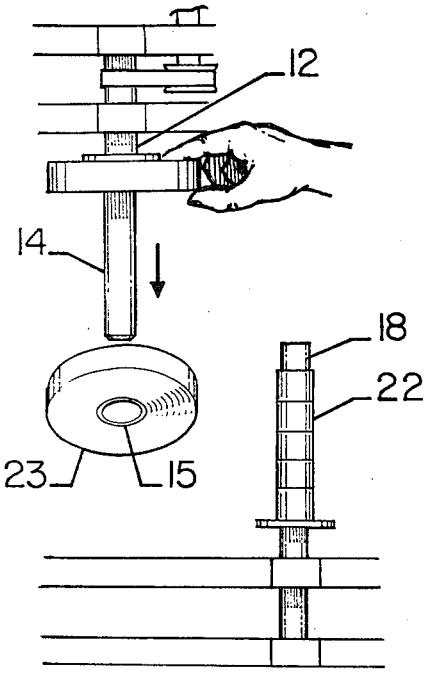
FIG. 3 is a schematic top view showing finished packages being removed from the driven support shaft of FIG. 1 upon conclusion of the winding operation.

At the conclusion of the winding operation, finished packages (23) are separated by standard cutting means from the endless webs of stock material from which they have been wound, and are removed from the driven support shaft (12) by manual means as shown in FIG. 3, or by automatic removal means, if desired. The finished packages (23) are simply and quickly moved from free end section (14) in its unexpanded configuration to a container, or a conveyor, or like transporting means (not shown), while secondary shaft (18), which is now loaded with unused cores, is located in its first position.

Upon the removal of the finished packages (23) from free end section (14), the secondary support shaft (18) is rapidly moved (by either standard translational or rotational means) to its second position, which is shown in FIG. 4. Thereupon, unused cores (22) are simply and speedily conveyed from secondary support shaft (18) onto free end section (14) of diven support shaft (12), while such free end section (14) is in its unexpanded configuration. This conveying is conveniently accomplished by hand, or by automatic conveying means, if desired. Once the unused cores (22) have been quickly moved into place on the free end section (14), the cores are secured in position thereon by causing the free end section to slightly expand radially by means of a fluid pressure supplied thereto (not shown), or by like securing means. The free ends (24) of the plurality of webs of stock material (16) are then individually attached rapidly to a separate core (22), as by stapling or like securing means, whereupon (or simultaneously therewith) secondary shaft (18) is quickly moved by standard translational or rotational means to its first position, and another winding operation is allowed to commence.

As a result of the present improvement, there is very little down time while finished packages are exchanged with new cores at the conclusion of a winding operation. Consequentially, the efficiency of the overall process is significantly improved. Especially beneficial results are achieved when the stock materian being wound is a cellulosic fiber strip, particularly that employed as "wallboard tape".

The present invention has been described in detail with respect to certain preferred embodiments thereof. As is apparent to those of skill in the art, variations and modifications in this detail may be effected without any departure from the spirit and scope of the present invention, as defined in the heretoappended claims.

I claim:

1. In a device for winding a plurality of endless webs of stock material on individual cores on a driven cantilevered support shaft to prepare finished packages of the stock material, the improvement therein for facilitating the exchange of finished packages on the driven cantilevered support shaft with new cores upon completion of a winding operation; the improvement comprising:

(a) a secondary, non-driven cantilevered support shaft located in a first positon in proximity to, but spaced from the driven support shaft, the secondary support shaft having a diameter which is substantially equal to the diameter of the driven support shaft, the secondary support shaft mounted for movement from the first position thereof to a second position thereof wherein the secondary support shaft and the driven support shaft are in a longitudinal, end-to-end alignment, and are contiguous;

(b) means for loading a plurality of unused cores onto the secondary support shaft during the winding operation, while the secondary support shaft is located in the first position thereof;

(c) means for removing the finished packages from the driven support shaft upon conclusion of the winding operation, while the secondary support shaft is located in the first position thereof;

(d) means for moving the secondary support shaft from the first position thereof to the second position thereof;

(e) means for conveying the unused cores from the secondary support shaft onto the driven support shaft and securing the cores on the shaft; and (f) means for moving the secondary support shaft from the second position thereof to the first position thereof, whereupon a new winding operation is allowed to commence.

* * * * *